US005422429A

United States Patent [19]

Shih et al.

[11] Patent Number: 5,422,429

[45] Date of Patent: Jun. 6, 1995

[54] DRAWER ACTIVATED MUSICAL ROTATING ORNAMENT

[76] Inventors: Bohr-Winn Shih, 2597 Sumac La., Boise, Id. 83706; Barry Shih, 2F, No. 321, Pateh Road, Sec. 4, Taipei 10563, Taiwan, Prov. of China

[21] Appl. No.: 145,327

[22] Filed: Oct. 29, 1993

[51] Int. Cl.[6] ..... G10F 1/06

[52] U.S. Cl. ..... 84/94.2; 40/411; 40/455; 446/404; 446/482

[58] Field of Search ..... 84/94.1, 94.2, 95.2; 446/404, 482; 40/411, 414, 415

[56] References Cited

U.S. PATENT DOCUMENTS

| | | | |
|---|---|---|---|
| 5,119,932 | 6/1992 | Semanoff | 84/94.2 X |
| 5,157,217 | 10/1992 | Feng | 84/95.2 |
| 5,226,845 | 7/1993 | Wu . | |
| 5,255,461 | 10/1993 | Chiou | 40/415 |

*Primary Examiner*—M. L. Gellner
*Assistant Examiner*—Patrick J. Stanzione
*Attorney, Agent, or Firm*—Frank J. Dykas

[57] ABSTRACT

A musical article of furniture, here jewelry chest (10) which includes at least one slidable drawer (12) for storage of articles and for activating and deactivating a musical movement (19). Mechanical spring wound musical movement (19) is attached to a supporting surface (14) of the housing (11) of chest (10) and has a rotating shaft, also serving as the winding shaft (21), protruding through an outside surface of chest housing (11). An ornament (34) is affixed to the shaft and the shaft is decoratively finished. Musical movement (19) is provided with a stop-and-start mechanism which includes a control arm (22) being positioned and configured to interfere with the back (13) of upper drawer (12) such that the mechanism will be activated when the drawer is opened and will shut off when the drawer is closed.

3 Claims, 5 Drawing Sheets

DRAWER ACTIVATED MUSICAL ROTATING ORNAMENT

BACKGROUND OF THE INVENTION

1. Technical Field

This invention generally relates to musical movements as they are applied to furniture. More particularly, this invention relates to a musical movement having a rotating ornament which is activated by a drawer in the article of furniture.

2. Background Art

Traditional music boxes are of a standard box-like configuration and include a mechanical spring wound musical movement which is activated by opening the box lid or opening a drawer. A separate winding key is provided through one side or the bottom of the box to tension the spring movement. These music boxes can be and are configured to serve as a place for storing jewelry, trinkets and other small valuables.

It would be desirable to provide an article of furniture such as a jewelry chest, which does not have a separate winding key and which includes a rotating ornament.

DISCLOSURE OF INVENTION

It is therefore an object of the present invention to provide an article of furniture with a musical movement without a traditional winding key. It is a further object of this invention to provide an article of furniture having a storage drawer which stops and starts the musical movement. Still, a further object of the present invention is to provide a decorative shaft for winding the musical movement, which serves an additional ornamental purpose by supporting an ornament on the rotating decorative shaft.

These objects and others are accomplished by an article of furniture which is highly ornamental in appearance and includes at least one slidable drawer for storage of articles and for activating and deactivating the musical movement. A mechanical spring wound musical movement is attached to a supporting surface of the housing of the furniture article and has a rotating shaft, also serving as the winding shaft, protruding through an outside surface of the housing. An ornament is affixed to the shaft and the shaft is decoratively finished.

The musical movement is provided with a stop-and-start mechanism which includes a control arm being positioned and configured to interfere with the back of the drawer such that the mechanism will be activated when the drawer is opened and will shut off when the drawer is closed. The control arm pivots between the on and off positions about a pivot lug which is attached to the underside of the musical movement. An upper portion of the control arm interferes with a radial flywheel type stopper to deactivate the mechanism. The stopper is axially affixed to a vertically disposed control shaft which has a helical worm gear at its upper end. The helical worm gear engages a large control gear affixed to a control shaft which has, at its other end, a small control gear meshedly engaged with the drive drum gear of the musical movement. The upper end of the control arm prevents the radial stopper from rotating, which in turn prevents the drum drive gear from rotating, thereby keeping the musical movement from operating.

BEST MODE FOR CARRYING OUT INVENTION

Figure 1:
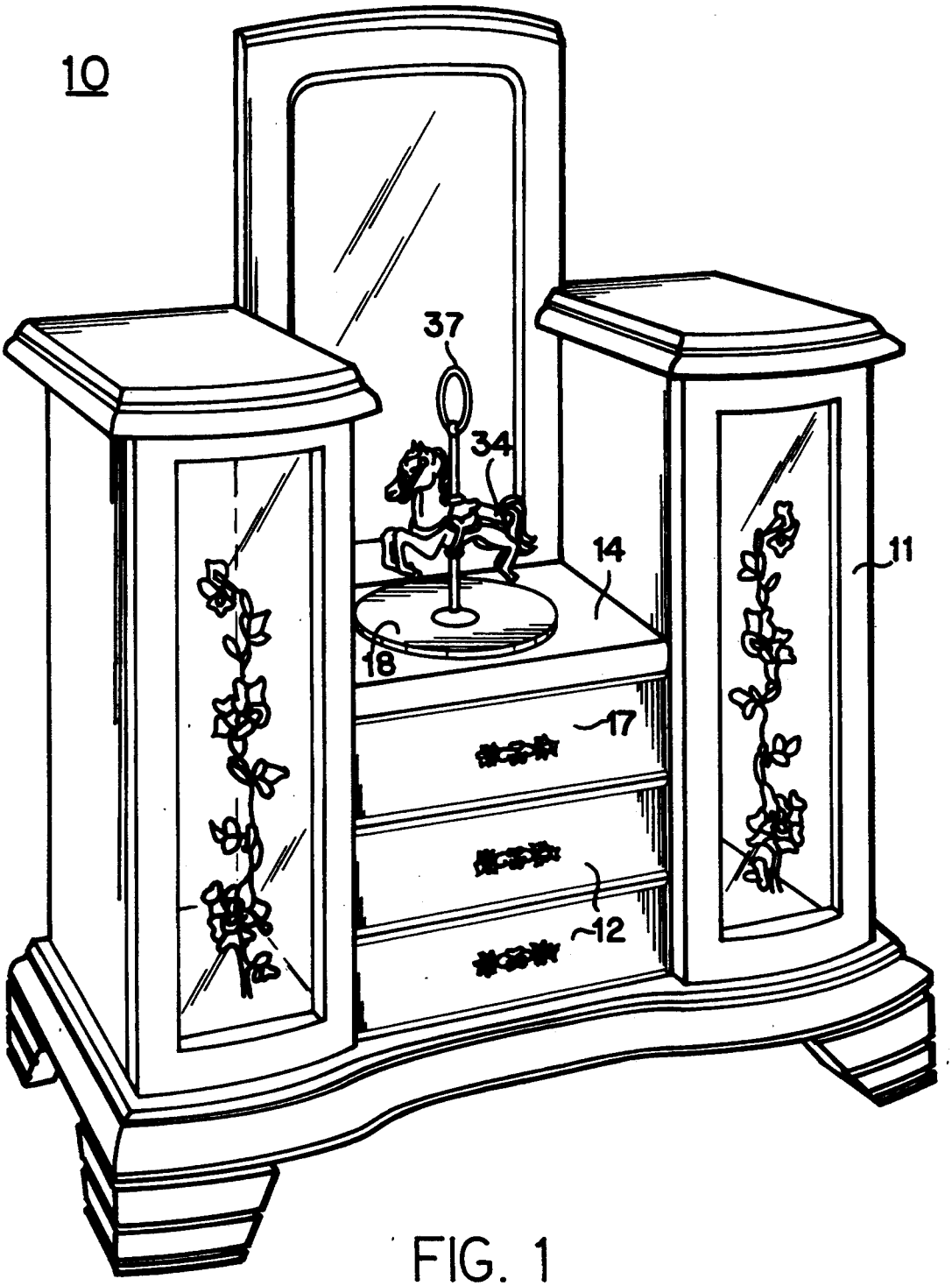
FIG. 1 is a front elevation view of a drawer activated musical jewelry chest, according to the principles of the present invention.
Figure 2:
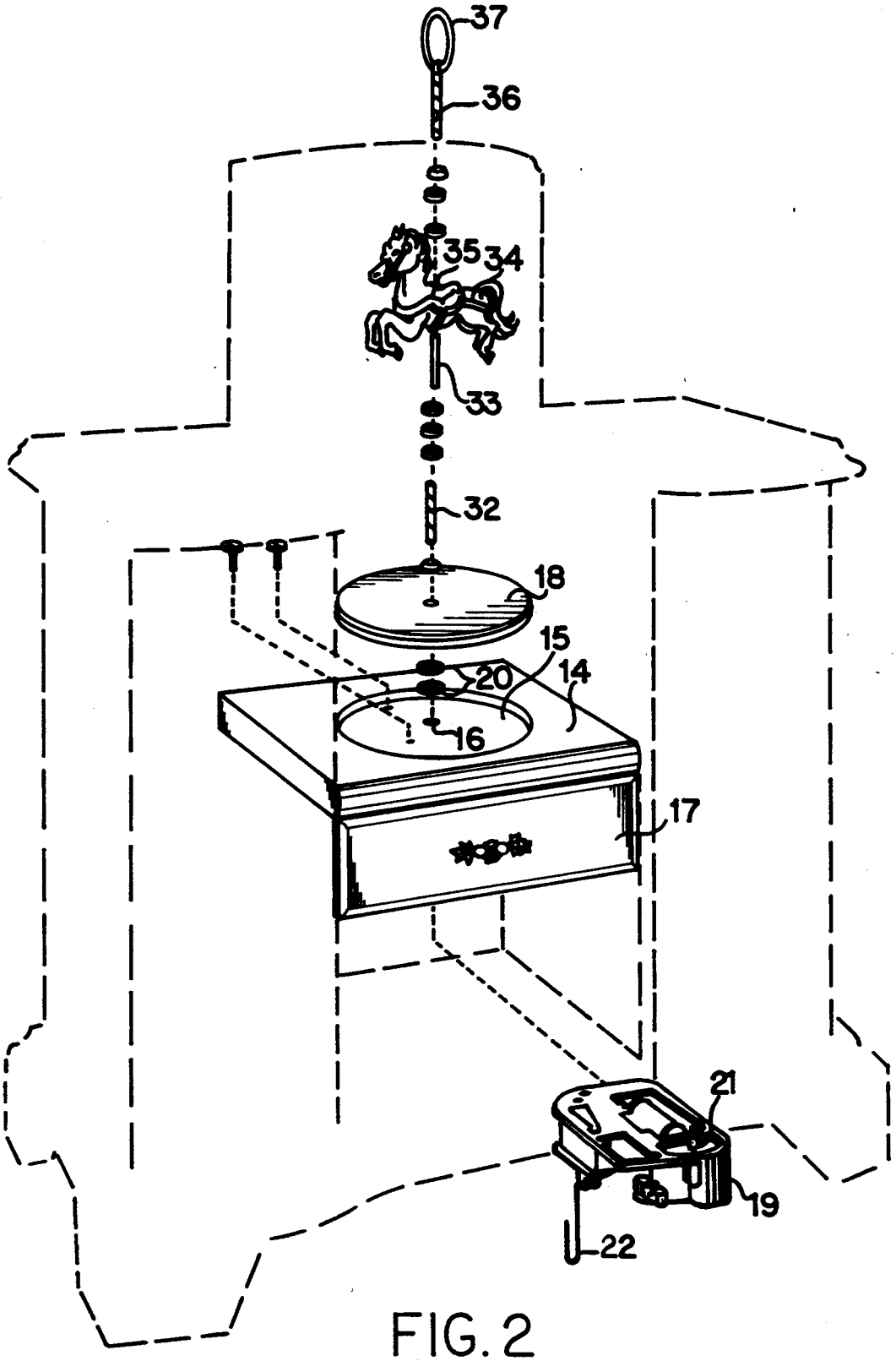
FIG. 2 is a front partially exploded view of the drawer activated musical jewelry chest.
Figure 3:
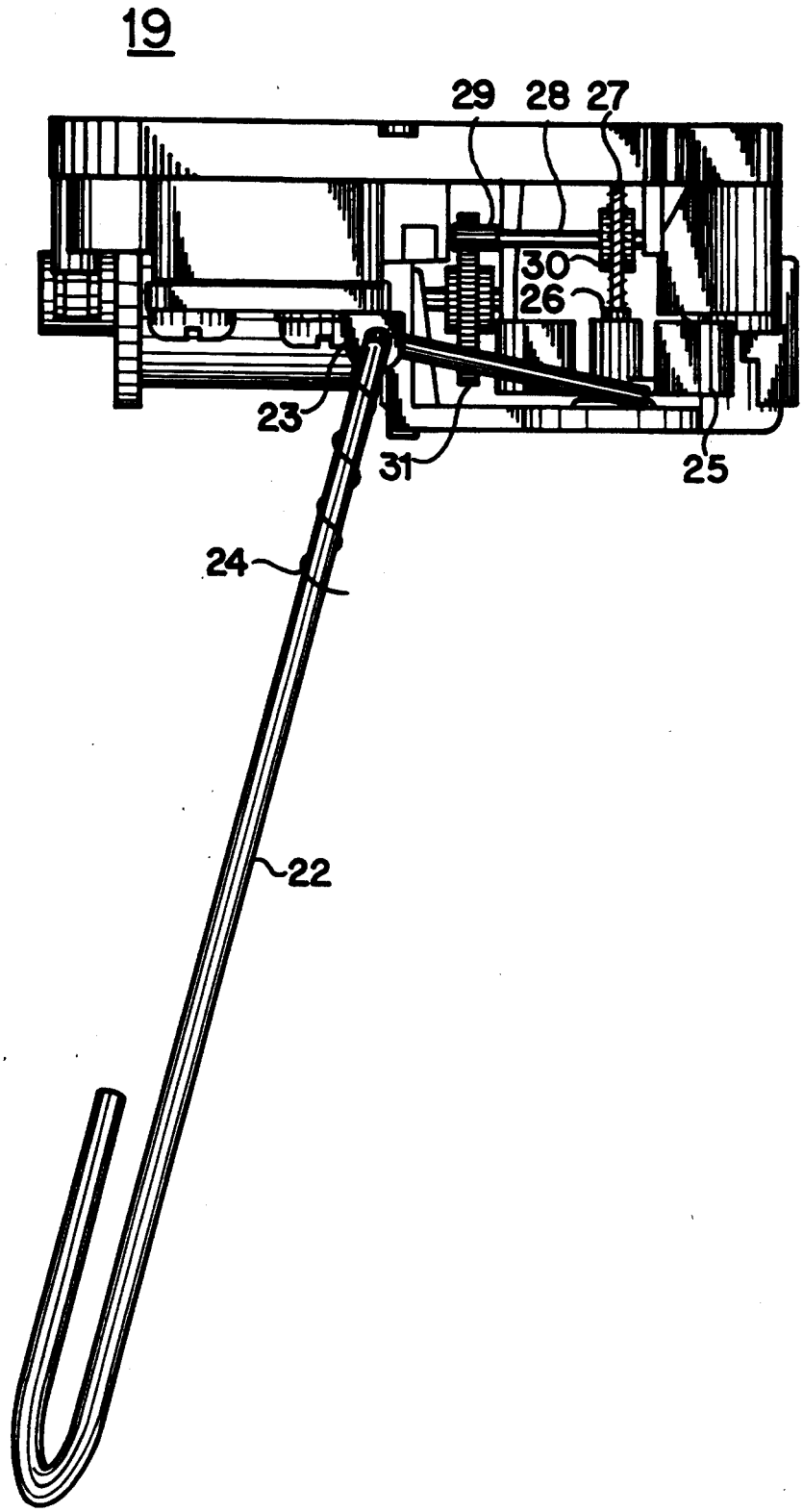
FIG. 3 is a side view of musical movement.
Figure 4:
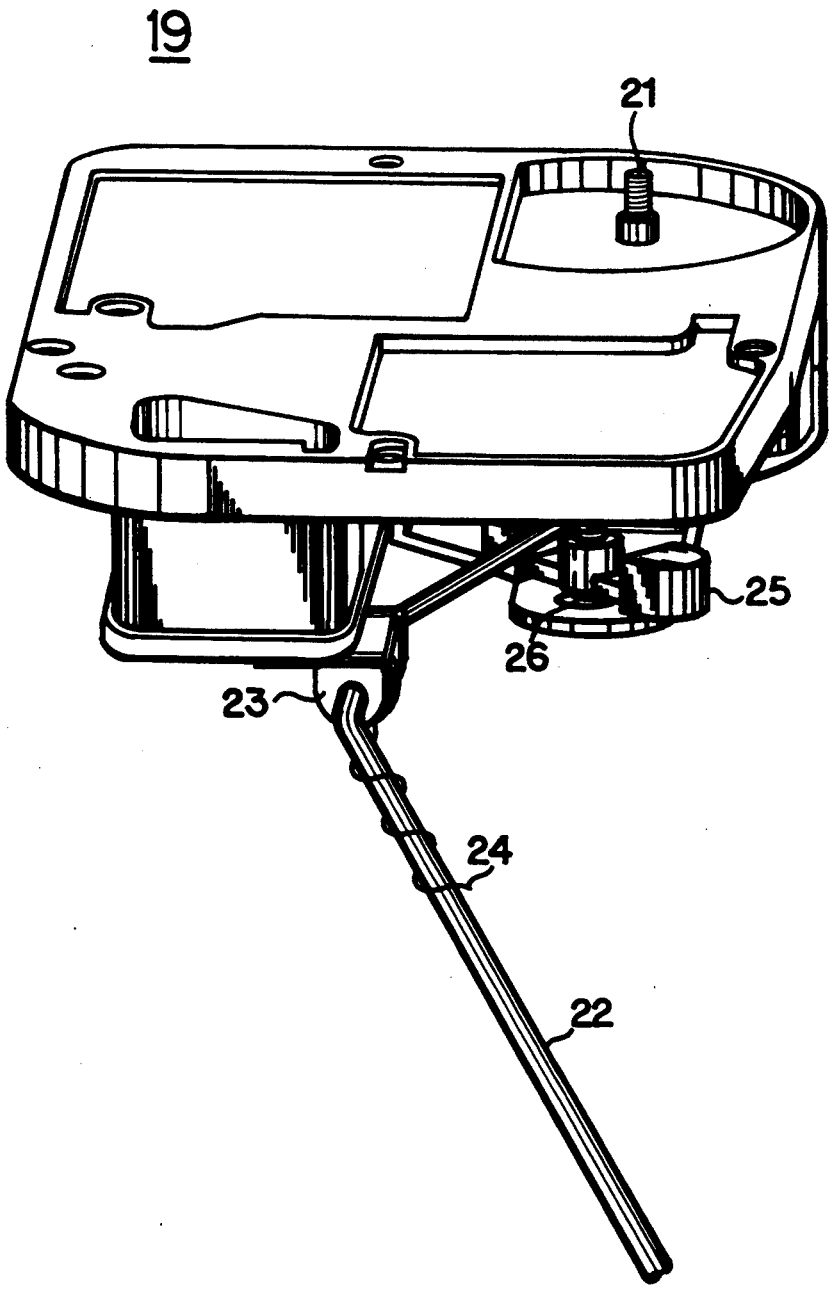
FIG. 4 is a side elevation view of the musical movement.
Figure 5:
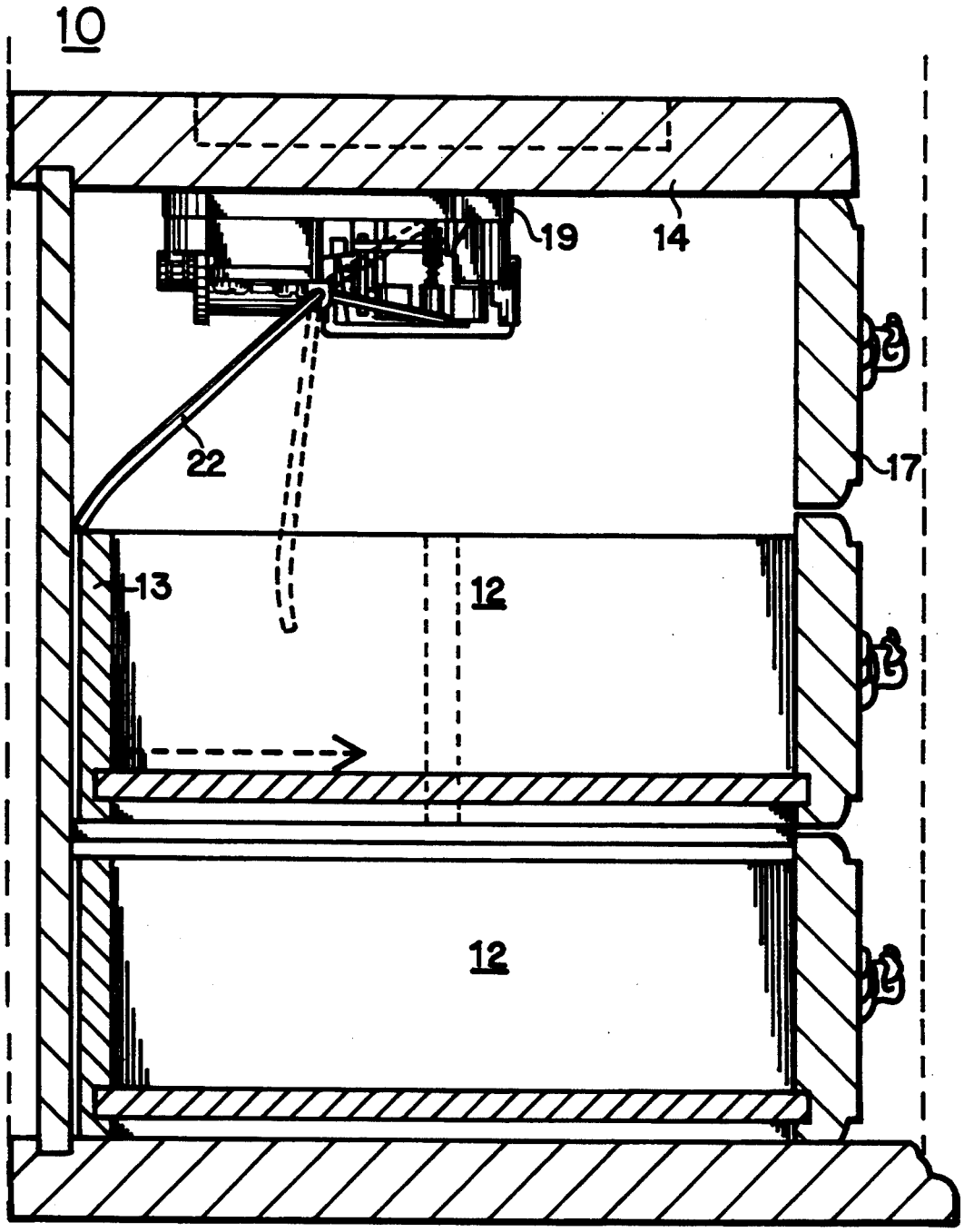
FIG. 5 is a partial side cut-away view of the drawer activated musical jewelry chest.

Referring now to the Figures, a drawer-activated jewelry chest is illustrated in detail and generally designated as 10, however it should be apparent that the invention is not limited solely to jewelry chests and can be adapted to many furniture articles. Drawer activated jewelry chest 10 includes a chest housing 11, here manufactured out of wood and glass, and is configured to be highly ornamental in appearance. Chest housing 11 includes a pair of drawers 12 for holding jewelry and other trinkets. Top member 14 acts as the musical movement supporting member and includes an annular plate recess 15. A decorative drawer plate 17 is provided along the front edge of musical movement supporting member 14 to form a hidden area directly under member 14 to house spring wound musical movement 19. Annular plate recess 15 is shaped and sized to receive disk-like ornament plate 18.

Spring wound musical movement 19 is attached to the underside of musical movement supporting member 14, using screws or the like, and has winding shaft 21 protruding up through winding shaft hole 16 in annular plate recess 15. Ornament plate 18 rests on a pair of thrust bearing washers 20 which are placed on the threaded stud of winding shaft 21. An ornament shaft, here composed of lower shaft extension 32, intermediate shaft extension 33 and an upper shaft extension 36, is attached to winding shaft 21 to support ornament 34 and to facilitate winding of musical movement 19.

Lower shaft extension 32 extends upward from winding shaft 21. Lower shaft extension 32 is here a brass tube which has threads circumvolving the inside of ends, the lower end being for threaded engagement with winding shaft 21. An intermediate shaft extension 33 is threadedly engaged within the upper end of lower shaft extension 32. Intermediate shaft extension 33 extends through intermediate shaft hole 35 in ornament 34. The upper end of intermediate shaft extension 33 is a threaded stud to which an upper shaft extension 36 is threadedly engaged. Upper shaft extension 36 is here also a brass tube which has threads circumvolving the inside surface of its lower end. A winding ring 37, alternatively a knob or the like, is radially fixed to the upper end of upper shaft extension 36 to facilitate winding of winding shaft 21.

Ornament 34 is here a porcelain carousel horse. It should be apparent that other decorative ornaments could be used as well, as could other compositions for the ornaments. The upper end of lower shaft extension 32 and the lower end of upper shaft extension 36 act to rigidly and radially affix ornament 34 on the axis of rotation of winding shaft 21. Similarly, the lower end of lower shaft extension 32, engages the upper surface of ornament plate 18 to axially affix it about winding shaft 21, such that the ornament rotates with the shaft.

Spring wound musical movement 19 is a standard spring wound musical movement with the exception of the stop and start mechanism. The stop and start mechanism includes an "L" shaped control arm 22 which is pivotally attached via pivot lug 23 to the underside of spring wound musical movement 19. L-shaped control arm 22 includes an upper distal end which is configured to interfere with a radial rubber stopper 25 which is affixed to vertical stopper shaft 26.

L-shaped control arm 22 is spring biased in its "on" position via torsion spring 24 which interacts with L-shaped control arm 22 and pivot lug 23. This position corresponds to top drawer 12 being open. When the lower end of L-shaped control arm 22 is pushed backward away from the front of chest housing 11, the upper end of L-shaped control arm 22 will interfere with radial rubber stopper 25. This position corresponds to the top drawer 12 being closed.

Radial rubber stopper 25 is axially affixed to the lower end of vertical stopper shaft 26. The upper end of vertical stopper shaft 26 has a worm gear 27 which is in meshed engagement with a large control gear 30 on control shaft 28. The opposite end of control shaft 28 has a small control gear 29 meshedly engaged with music drum drive gear 31. The gear ratio between worm gear 27, large control gear 30, small control gear 29 and music drum drive gear 31 is selected such that a very light interference with radial rubber stopper 25 will stop music drum drive gear 31 from rotating.

In use, the user winds musical movement 19 by rotating winding ring 37 about the axis of rotation of winding shaft 21. Once musical movement 19 is wound up, upper drawer 12 is opened, which allows L-shaped control arm 22 to pivot to its on position, it being pushed forward by torsion spring 24. To shut the music off, the user simply pushes lower drawer 12 to its closed position.

While there is shown and described the present preferred embodiment of the invention, it is to be distinctly understood that this invention is not limited thereto but may be variously embodied to practice within the scope of the following claims.

We claim:

1. A musical article of furniture which comprises:

a housing including a musical movement supporting member having an inside surface and an outside surface;

a musical movement being affixed to the inside surface of the musical movement supporting member and having a rotating shaft extending through the musical movement supporting member;

an ornament shaft being axially aligned with and affixed to the rotating shaft;

an ornament being radially affixed to the ornament shaft;

a drawer being slidably engaged in the housing and slidable between an open position and a closed position; and musical movement stop and start means being attached to the musical movement and being configured and positioned to interfere with the drawer to start the musical movement when the drawer is in its open position and stop the musical movement when the drawer is in its closed position, the musical stop and start means including a control arm being positioned to mechanically interfere with the drawer and the musical movement when the drawer is in its closed position to define an off position and being spring biased toward an on position in which the control arm is free from interference with the musical movement to turn the musical movement on when the drawer is in its open position.

2. A musical article of furniture which comprises:

a housing including a musical movement supporting member having an inside surface and an outside surface;

a musical movement being affixed to the inside surface of the musical movement supporting member and having a rotating shaft extending through the musical movement supporting surface;

an ornament shaft being axially aligned with and affixed to the rotating shaft;

an ornament being radially affixed to the ornament shaft;

a drawer being slidably engaged in the housing and slidable between an open position and a closed position;

musical movement stop and start means being attached to the musical movement and being configured and positioned to interfere with the drawer to start the musical movement when the drawer is in its open position and stop the musical movement when the drawer is in its closed position;

wherein the musical stop and start means further includes a control arm being positioned to interfere with the drawer when the drawer is in its closed position to define an off position and being spring biased toward an on position to turn the musical movement on when the drawer is in its open position, the control arm being generally "L" shaped and having an upper end and a lower end;

a lug extending from the musical movement and pivotally engaging the control arm;

a torsion spring being interconnected between the control arm and the lug, and configured to bias the control arm in an on position;

a rotatable vertical stopper shaft extending down from the musical movement and having a radially disposed stopper extending therefrom being positioned to interfere with the upper end of the control arm when the control arm is in its off position, the vertical shaft further having a worm gear formed thereon;

a control shaft having a large control gear attached thereto being in meshed engagement with the worm gear, the control shaft also having a small control gear thereon; and a drum drive gear being in meshed engagement with the small control gear, the small control gear preventing the drum drive gear from rotating when the upper end of the control arm interferes with the stopper.

3. A musical article of furniture which comprises:

a housing including a musical movement supporting member having an inside surface and an outside surface;

a musical movement being affixed to the inside surface of the musical movement supporting member and having a rotating shaft extending through the musical movement supporting surface;

an ornament shaft being axially aligned with and affixed to the rotating shaft;

an ornament being radially affixed to the ornament shaft;

a drawer being slidably engaged in the housing and slidable between an open position and a closed position;

musical movement stop and start means being attached to the musical movement and being configured and positioned to interfere with the drawer to start the musical movement when the drawer is in its open position and stop the musical movement when the drawer is in its closed position;

wherein the musical stop and start means further includes a control arm being positioned to interfere with the drawer when the drawer is in its closed position to define an off position and being spring biased toward an on position to turn the musical movement on when the drawer is in its open position, the control arm being generally "L" shaped and having an upper end and a lower end;

a rotatable vertical stopper shaft extending down from the musical movement and having a radially disposed stopper extending therefrom being positioned to interfere with upper end of the control arm when the control arm is in its off position.

* * * * *